United States Patent [19]

McCallum et al.

[11] Patent Number: 4,467,890

[45] Date of Patent: Aug. 28, 1984

[54] LADDERS

[75] Inventors: Bruce D. McCallum, Warkworth; Scott J. McCallum, Matakana, both of New Zealand

[73] Assignees: McCallum Enterprises Limited; Federated Farmers of New Zealand; Auckland Province Inc., all of Auckland, New Zealand

[21] Appl. No.: 394,152

[22] Filed: Jul. 1, 1982

[51] Int. Cl.[3] ..... E06C 1/36

[52] U.S. Cl. ..... 182/206; 182/100; 182/189

[58] Field of Search ..... 182/206, 93, 100, 189, 182/133–136

[56] References Cited

U.S. PATENT DOCUMENTS

| | | | |
|---|---|---|---|
| 631,302 | 8/1899 | Harper | 182/206 |
| 1,091,277 | 3/1914 | Bloom | 182/134 |
| 1,142,072 | 6/1915 | Wingerd | 182/206 |
| 3,896,900 | 7/1975 | Hunter | 182/206 |
| 3,995,714 | 12/1976 | Brookes | 182/206 |
| 4,225,013 | 9/1980 | Sample | 182/134 |
| 4,368,801 | 1/1983 | Lewis | 182/134 |

FOREIGN PATENT DOCUMENTS

| | | | |
|---|---|---|---|
| 766584 | 4/1934 | France | 182/134 |
| 2342492 | 10/1977 | France | 182/134 |

*Primary Examiner*—Reinaldo P. Machado
*Attorney, Agent, or Firm*—Holman & Stern

[57] ABSTRACT

A ladder is provided with an attaching device at its top end whereby it can be quickly and securely attached to a vertical pole, tree-trunk or the like. The attaching device comprises a pair of jaws to pass one on each side of the vertical pole, and it can pivot until the jaws engage the pole. The ladder is suspended from the pivot of the attaching device, and may then be secured at its bottom end to prevent it from swinging.

9 Claims, 12 Drawing Figures

LADDERS

BACKGROUND OF THE INVENTION

1. Field of the Invention

This invention is concerned with improvements in or relating to ladders.

2. Description of the Prior Art

A problem is sometimes faced by persons wishing to climb upwardly projecting members, such as tree trunks, or telegraph poles, or power poles for example. Often the nature of the ground at the foot of such upwardly projecting members is unsuitable for supporting conventional types of ladders. Furthermore, even if the ground should be sufficiently level and firm to support the ladder, the top end of the ladder which is rested against the upwardly projecting member may not always be securely positioned. The top of the ladder can be secured but this necessitates a person having to climb the ladder in the first place. It was with such problems in mind that the present invention was devised.

SUMMARY OF THE INVENTION

The present invention broadly consists in a ladder supporting apparatus for use with a ladder, the apparatus comprising a device having a body portion, a ladder attaching means at or towards an end of said body portion by which a ladder is attached or is attachable or engageable with, said body portion and rigid engaging means located at the other end of the body portion for engaging with an upwardly projecting member in use, the engaging means having: a first jaw attached to said other end of the body portion and lying transversely with respect to the body portion, and a second jaw attached to or engaged with the device and extending across the first jaw from a side of that first jaw, there being lateral opening or mouth to a space between the jaws at the other side of the first jaw; the construction and arrangement being such that with lateral movement of the device with respect to said upwardly projecting member this can be made to pass through said mouth to be located between the jaws which act to grip the upwardly projecting member when weight is applied to the body portion of the device.

BRIEF DESCRIPTION OF THE DRAWINGS

The embodiments of this invention will now be described in greater detail with reference to the accompanying drawings wherein.

DESCRIPTION OF THE PREFERRED EMBODIMENTS

Figure 1:
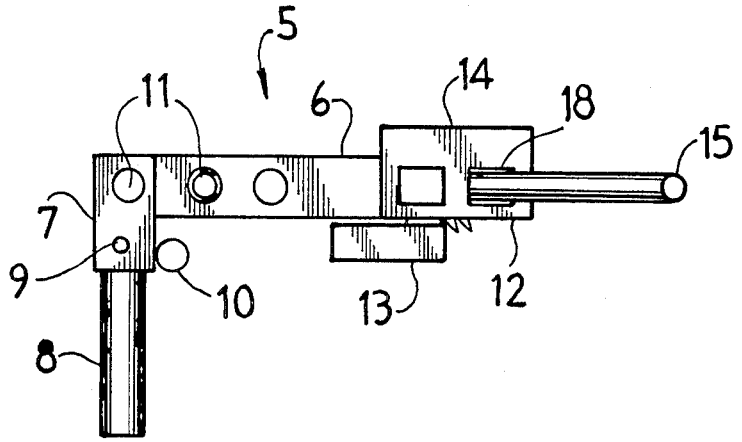
FIG. 1 is a schematic side elevational view of a first upper ladder supporting device of the invention taken on line I—I of FIG. 2.
Figure 2:
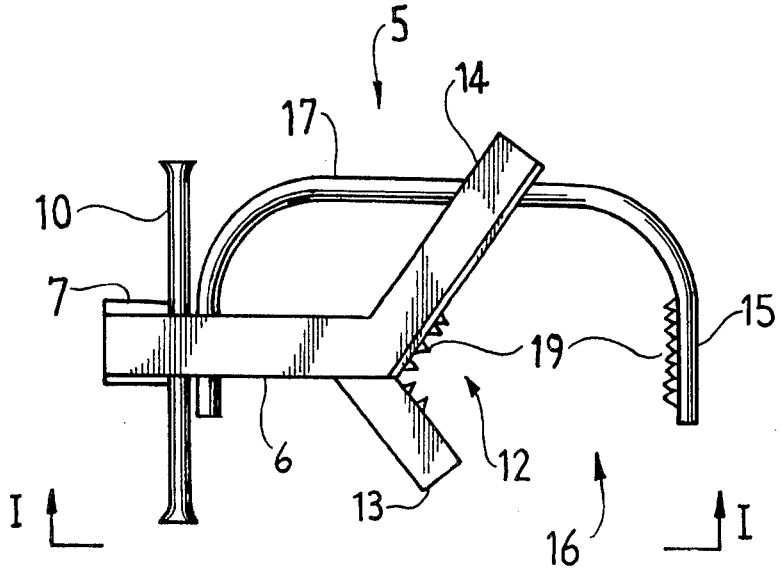
FIG. 2 is a top plan view of the first ladder supporting device of FIG. 1.
Figure 3:
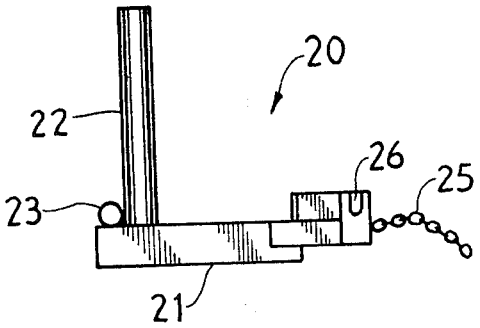
FIG. 3 is a schematic side elevational view of a second lower ladder supporting device of the invention taken on line III—III of FIG. 4.
Figure 5:
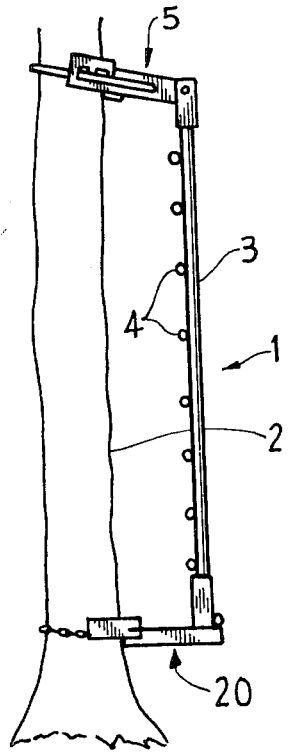
FIG. 5 is a schematic side elevational view illustrating the apparatus of the invention in use.
Figure 4:
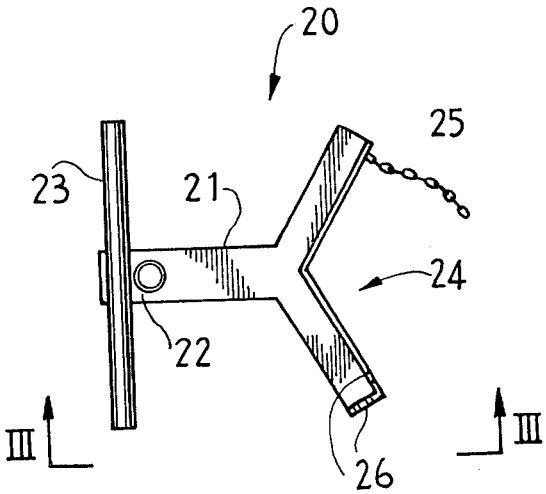
FIG. 4 is a top plan view of the second ladder supporting device of FIG. 3.

According to the invention an apparatus is provided whereby a ladder 1 can be completely supported by an upwardly projecting member which is desired to be climbed. Such an upwardly projecting member might be a tree trunk 2, or post, or pole such as a telegraph pole or power pole. Thus the upwardly supporting member will normally, though not necessarily, have a substantially circular cross section.

While most upwardly projecting members with which the invention might be used would project perpendicularly with respect to the ground, others may project upwardly at some other angle with respect to the ground.

The preferred ladder comprises a single pole 3 to which rungs 4 are attached to project on either side of the pole. A single latter may be made to an desired length. It is also desirable that such ladder can be used as ladder sections which can be joined end to end to create a longer ladder. The ladder sections can be joined by any suitable means, for example the ends of the ladder sections may comprise plug and socket type fitting which could be pinned together or screwed together.

The top end of the ladder is secured to the upwardly projecting member 2 by means of a first ladder supporting device of top fitting 5. The top fitting has a body portion 6 and the ladder is attached, or attachable or engagable, at or towards an end of this body portion. The ladder and top fitting may be permanently attached, but it is preferable that they are separable. To this end, plates 7 are welded to each side of the body portion and project downwardly. Between the plates, a plug member 8 is attached, preferably by means of a pivotal connection 9. A rung 10 may also be attached to the plates 7. The body portion preferably has a plurality of holes 11 spaced along part of its length, the purpose of which will be described later.

At its other end the body portion has rigid engaging means for engaging with the upwardly projecting member. The engaging means has a first jaw 12 which lies transversely with respect to the body portion. This is preferably made up of two diverging jaw members 13 and 14 attached to the end of the body portion and one of the jaw members 14 may be longer than the other. The engaging means also has a second jaw 15 attached to or engaged with the device and extending across the first jaw from a side of that first jaw. At the other side of the first jaw, there is a lateral opening or mouth 16 to a space between the jaws. The second jaw is provided at or towards an end of an elongate jaw member 17, the other end of which is attached to or engaged with the body portion. In this form of the invention, the second jaw is adjustable in position so that the spacing between the jaws can be varied and for this purpose, the attachable end of the member 17 is shaped to fit into any one of the holes 11 in the body portion. The member 17 also passes through an aperture 18 in the longer jaw member 14 of the first jaw. This provides support for the jaw member 17 and prevents its inadvertent disengagement from the body portion in use. The jaw member 17 can be swung in the aperture 18 to allow disengagement of its end from one of the holes 11.

In use, the first ladder supporting device will normally be attached to the top end of a ladder, a socket on the end of the ladder pole 2 fitting over the plug 8 of the device and the two pinned or screwed together. The ladder is maneuvered so that with lateral movement of the device with respect to the upwardly projecting supporting member, this can be made to pass through the mouth 16 to be located between the jaws 12 and 15 which act to grip the upwardly projecting member when weight is applied to the body portion of the device. The ladder itself provides such a weight, though the weight of the body portion itself may be sufficient. To improve the grip of the device, gripping means such as teeth 19 are preferably provided on both jaws. For greater stability, it is preferred that the apparatus include a second ladder supporting device or bottom end fitting 20. This is somewhat similar to the top end fitting but does not have a part corresponding to the second jaw. It has a body portion 21 to which the bottom end of the ladder is attached or is attachable or engagable. To achieve this, at or towards an end of the body portion there may be an upwardly projecting tube 22 into which the bottom end of the ladder pole can be inserted and pinned or screwed. There may also be a rung 23. At the other end of the body portion, there is a bracing means 24 comprising two diverging members attached to the end of the body portion. In use, the upwardly projecting member is located within the V of the bracing means. A flexible tie, such as chain 25, may be provided to prevent the bottom fitting from inadvertently separating from the pole or tree. One end of the chain is attached to an end of the bracing means and the other end of the chain can be passed around the pole or tree and any link of the chain engaged with a hook or slots 26 at the other end of the bracing means.

In FIGS. 6 to 9 parts corresponding to those parts illustrated in FIGS. 1 to 5 are given like numbers.

Figure 6:
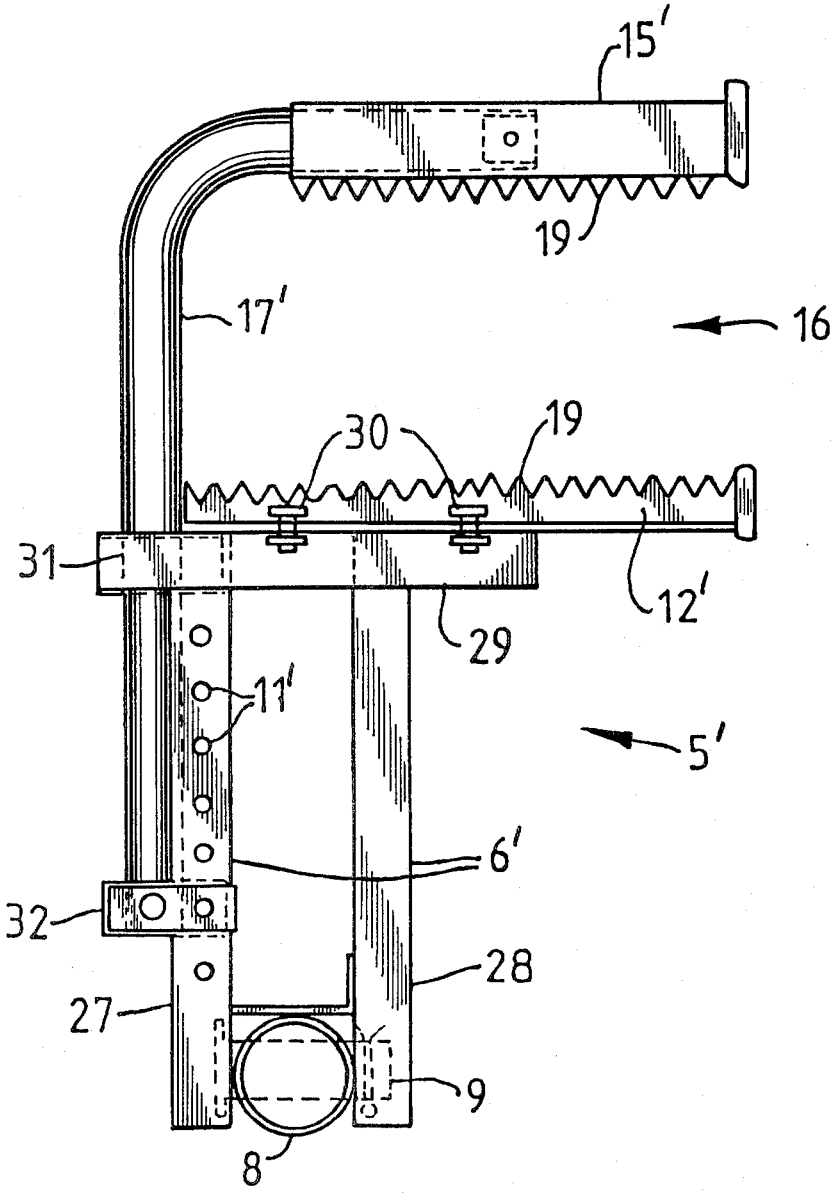
FIG. 6 is a top plan view of an alternative embodiment of the first ladder supporting device according to the invention.

With reference to FIG. 6, which shows an alternative first ladder supporting device or top end fitting 5', the body portion 6' is made from two lengths of channel section 27 and 28. Across one end there is a transverse length of channel section 29. This functions as a first jaw supporting member. The first jaw 12' may be permanently attached to this but it is preferably attached by releasable means such as bolts 30. Similarly the second jaw 15' may be releasably attached to the elongate jaw member 17'. These arrangements allow the jaws 12' and 15' to be replaced with alternatives which may, for example, have a rubber layer on their inner faces instead of teeth so as to be suitable for use on concrete poles or other surfaces where teeth might not be as suitable.

The end of the jaw 12' is preferably extended downwardly and the end of jaw 15' is preferably extended upwardly. When the top end fitting is attached to a trunk or pole it usually is angled downwardly away from the jaw end and thus these short extensions help prevent lateral movement of the top end fitting relative to the trunk or pole whereby the two might be inadvertently disengaged.

The elongate jaw member 17', to which the second jaw 15' is attached, slidably passed through an aperture 31 at one end of the first jaw support member 29 and at its end opposite to that which the second jaw is attached has attached to it a piece of channel section 32, the arms of which slidably pass over the channel section 27. Holes in the arms of the channel section 32 allow a bolt or pin or the like to be passed through these and through any one of the holes 11' in the channel section 27 to fix the gap between the two jaws. At the end of the top end fitting 5' opposite that having the jaws a tube or rod 8' is pivotally attached to depend downwardly and this is permanently attached or preferably releasably attachable to the top end of the ladder.

Figure 8:
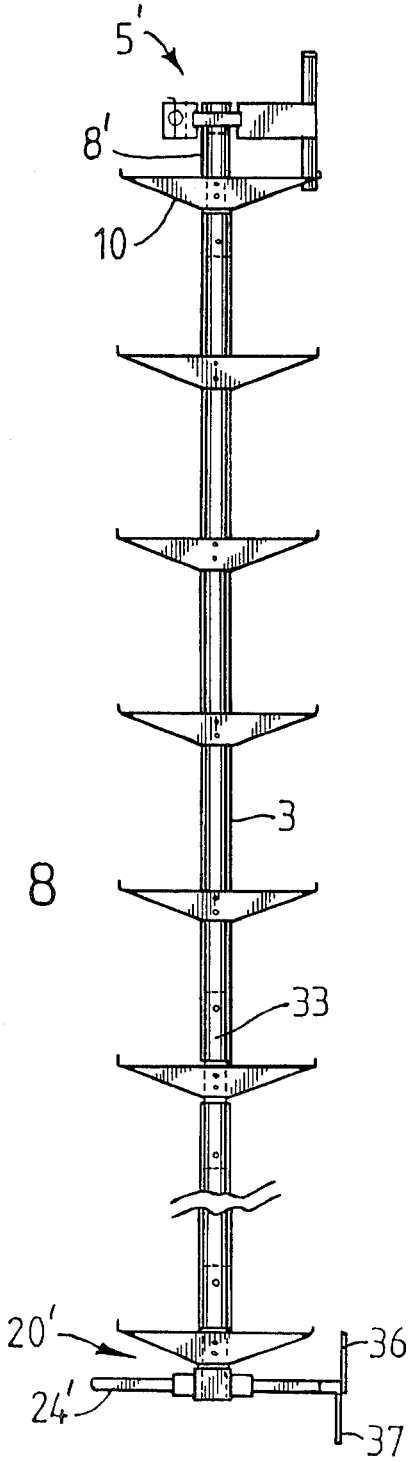
FIG. 8 is a front elevational view of a ladder comprising two ladder sections joined together, the alternative first latter supporting device being attached at the top end of the ladder and the alternative second ladder supporting device being attached at the bottom end of the ladder.

With reference to FIG. 8 a ladder is shown which is made of two ladder sections which are releasably joined end to end by means of a plug member 33 which itself bears a rung.

Figure 7:
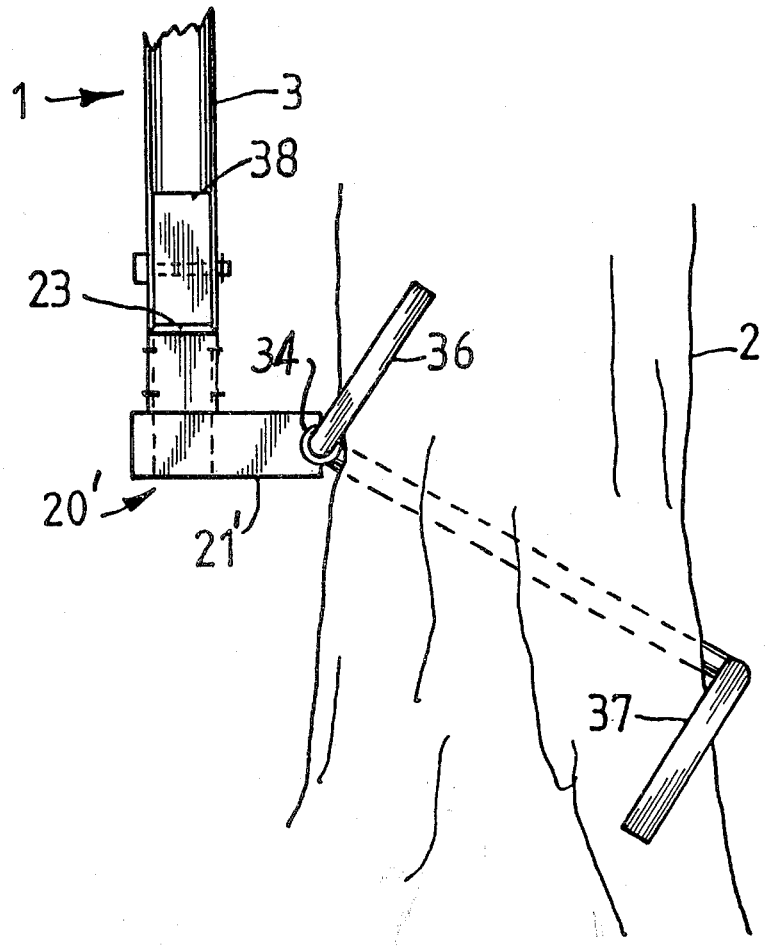
FIG. 7 is a side elevational view showing the engagement of an alternative embodiment of the second ladder supporting device attached at the bottom end of a ladder to the trunk of a tree.
Figure 9:
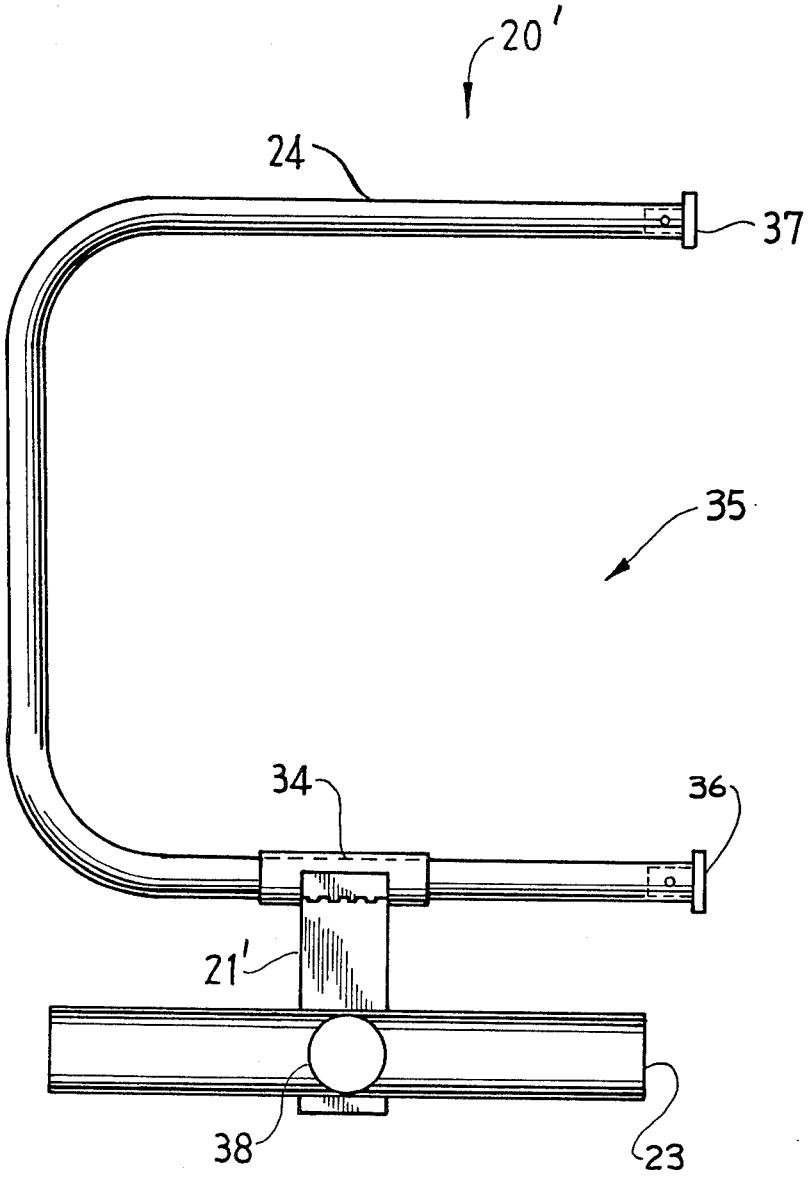
FIG. 9 is a top plan view of the alternative second ladder supporting device.

FIGS. 7 and 9 show the alternative second ladder supporting device of bottom end fitting. In this form of the invention a tube 34 is attached to an end of the body portion 21'. The bracing member is substantially U-shaped and one arm of this passes through the tube 34 and is preferably slidable and pivotable with respect to tube 34. As shown in FIG. 9 the bracing means has a lateral opening 35 and so is somewhat similar, in some respects, to the top end fitting. In fact, with appropriate modifications, it could be adapted for use as a top end fitting but would have the disadvantage of a fixed jaw spacing.

The end 36 of the inner arm of the bracing member is preferably extended upwardly whereas the end 37 of the outer arm of the bracing member is preferably extended downwardly. The function of the extensions 36 and 37 is illustrated in FIG. 7 where it is shown that, in use, they act to prevent inadvertent lateral movement of the bottom end fitting relative to the trunk or pole causing disengagement of the bottom end fitting. At the end of the body portion 21' opposite that having the bracing member there is an outwardly projecting tube or rod 38 to which a rung 23 is attached intermediate of its length. This rod or tube 38 provides a plug over which the bottom end of a tubular ladder pole 3 can be fitted and then bolted.

Figure 10:
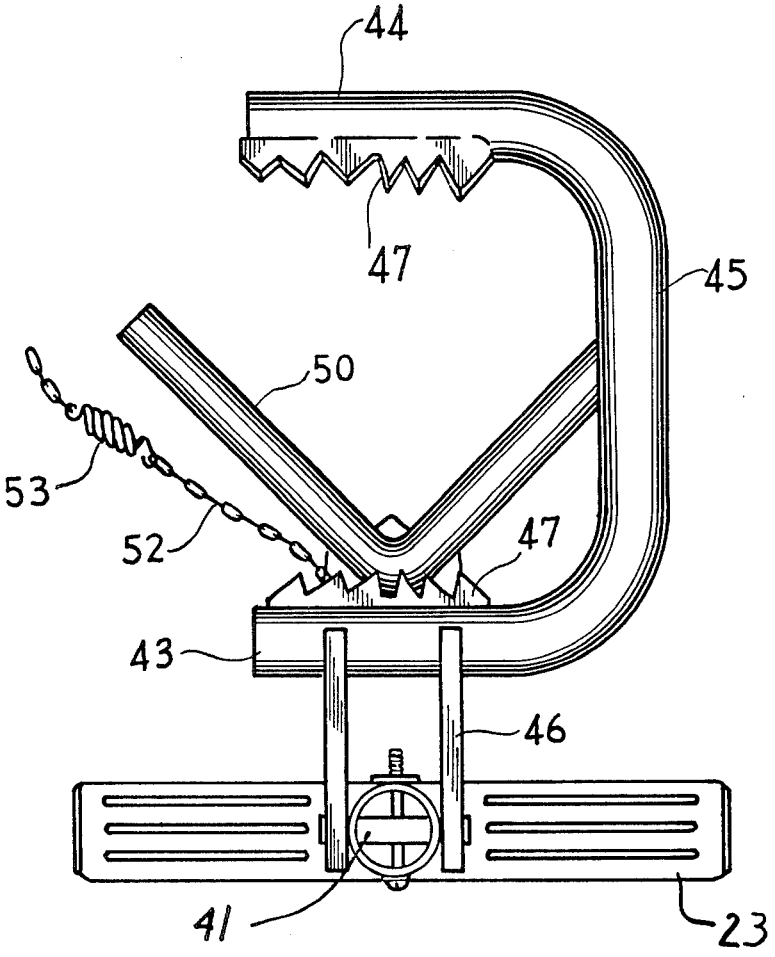
FIG. 10 is a top plan view of a further embodiment of a ladder supporting device and ladder according to the invention.
Figure 11:
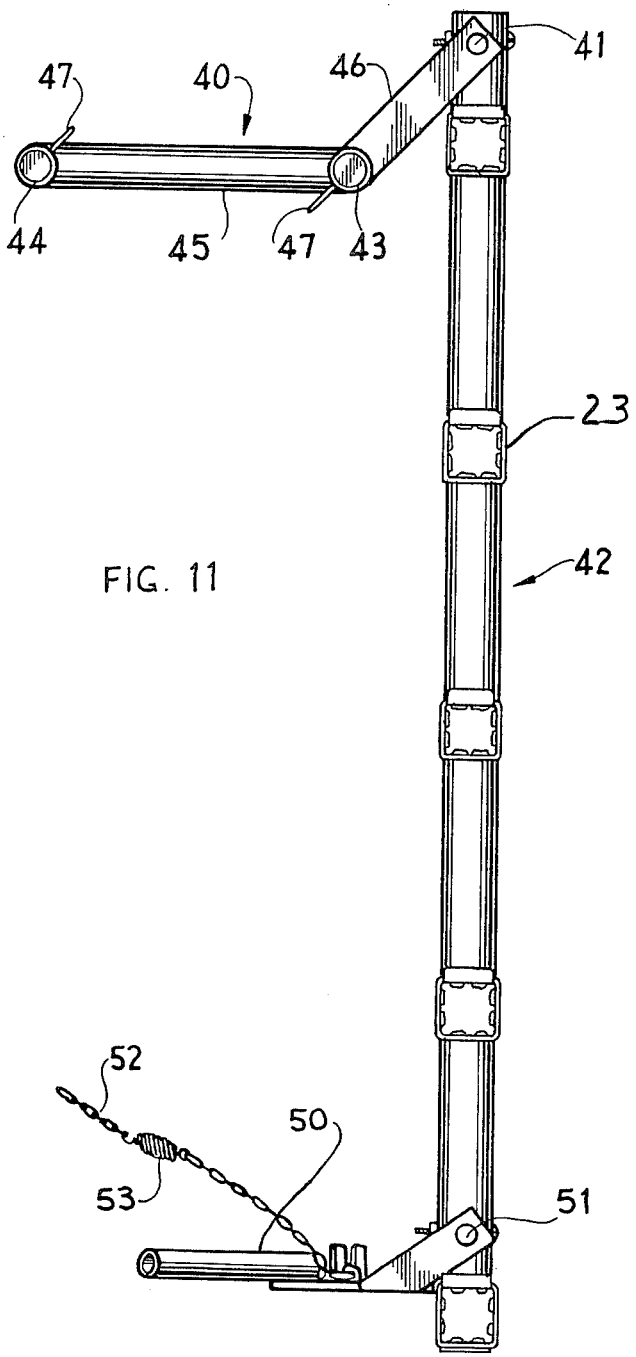
FIG. 11 is a side elevational view of the device shown in FIG. 10.
Figure 12:
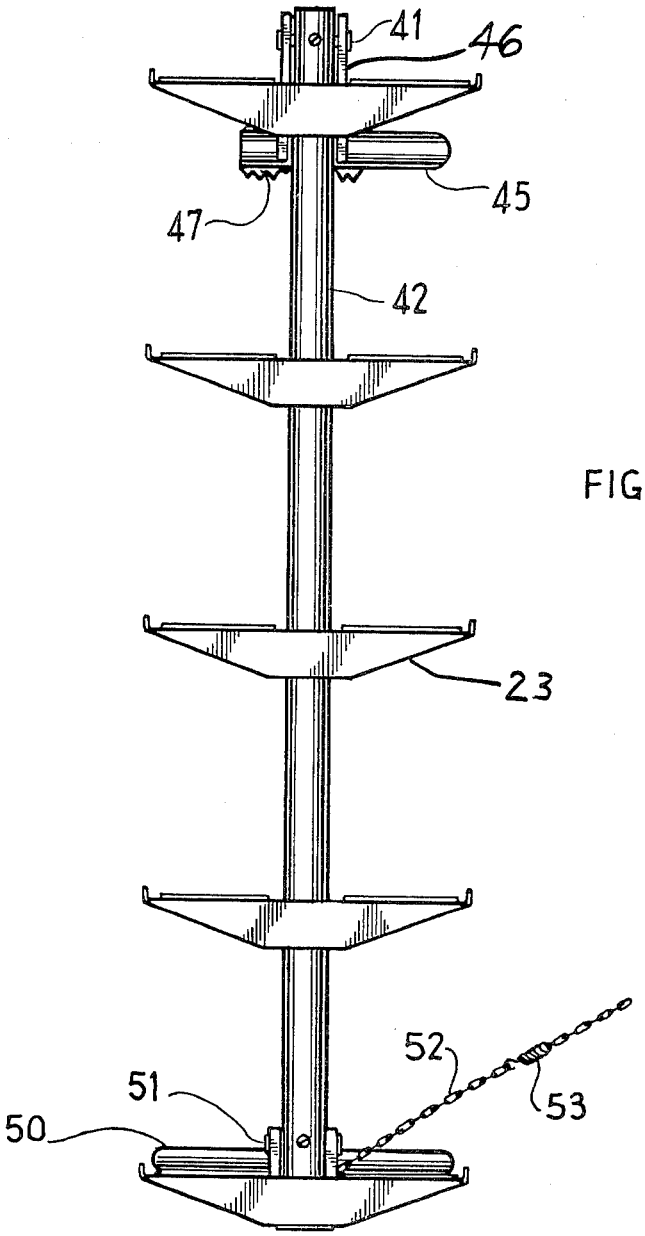
FIG. 12 is a front elevational view of the ladder shown in FIGS. 10 and 11.

FIGS. 10 to 12 show a further alternative ladder supporting device 40. The device 40 is pivotally connected at 41 to the top end of a ladder 42, the pivotal connection 41 being above the plane of the jaws 43,44, both of which are part of a single, U-shaped body member 45. A pair of brackets 46 extend between the body member and the pivot 41. The angle between the brackets 46 and the body member 45 substantially reduces the need to make the spacing between the jaws adjustable.

The jaws are shown with teeth 47, but these may be replaced with a rubber or other non-skid strip if the device is to be used for climbing concrete or steel poles.

The bottom end fitting 50 is similar to the fitting 20 described above, except that it, too, is pivoted directly to the ladder at 51. Attached to the fitting 50 is a chain 52, incorporating a tension spring 53 to provide some give in the tie around the base of the tree or pole.

It should be realized that the top and bottom end fittings can be sold separately and that these can be adapted for use with conventional types of ladder. Where the top and bottom fittings and ladders are to be used in connection with power poles then it is desirable that these be made of an insulating material such as fiberglass, for example. Alternatively metallic materials covered with an insulating material might be used.

While some variations of the invention have been indicated various other modifications can be made without departing from the scope of the invention as broadly defined. For example, if the device is to be used for only one size and shape of upwardly projecting member, then the second jaw may be fixed in position. The first and second ladder supporting devices have been referred to as top and bottom end fittings respectively because in the preferred form of the invention they are located at the top and bottom ends respectively of the ladder. However, in a modification of the invention, one or both of these fittings may be attached or attachable to the ladder intermediate of its length. The various components of the apparatus are preferably made from steel or aluminium but other materials can be used.

We claim:

1. A ladder support attachable to a ladder and adapted to grippingly engage an object such as a pole, tree or the like comprising, an open loop shaped gripping member having two spaced gripping parts adapted to engage substantially opposite portions of the object, an intermediate part spanning between said spaced parts, and an open mouth through which the gripping member is positioned on the object, a ladder mounting bracket attached at one end to one of said spaced gripping parts and extending therefrom obliquely upwardly and outwardly with respect to said gripping member when the plane of said gripping member is substantially horizontal in position for use, and means for pivotally connecting the other end of said bracket to a ladder so that said gripping member can swing substantially vertically towards and away from the ladder to produce self-clamping of said gripping member on said object.

2. A ladder support as claimed in claim 1 wherein said one end of said bracket is rigidly attached to said gripping member.

3. A ladder support as claimed in claim 2 wherein said gripping member is substantially U-shaped and said gripping parts are substantially straight and parallel with respect to each other.

4. A ladder support as claimed in claim 3 and further comprising teeth on each gripping part extending inwardly of said U.

5. A ladder comprising, at least one elongated step supporting member having upper and lower ends in use, a plurality of steps mounted on said step supporting member, and a ladder support comprising, an open loop shaped gripping member having two spaced gripping parts adapted to engage substantially opposite portions of the object, an intermediate part spanning between said spaced parts, and an open mouth through which the gripping member is positioned on the object, a ladder mounting bracket attached at one end of one of said spaced gripping parts and extending therefrom obliquely upwardly and outwardly with respect to said gripping member when the plane of said gripping member is substantially horizontal in position for use, and means for pivotally connecting the other end of said bracket to a ladder so that said gripping member can swing substantially vertically towards and away from the ladder to produce self-clamping of said gripping member on said object.

6. A ladder as claimed in claim 5 wherein said one end of said bracket is rigidly attached to said gripping member.

7. A ladder as claimed in claim 6 wherein said gripping member is substantially U-shaped and said gripping parts are substantially straight and parallel with respect to each other.

8. A ladder as claimed in claim 7 and further comprising teeth on each gripping part extending inwardly of said U, said teeth extending toward the ladder being directed at an acute angle upwardly and said teeth extending away from the ladder being directed at an acute angle downwardly with respect to a horizontal plane.

9. A ladder as claimed in claim 8 wherein said step supporting member comprises a single spine, said steps comprise treads in the form of cross-members attached to and extending on opposite sides of said spine, and said bracket is connected to said spine.

* * * * *

UNITED STATES PATENT AND TRADEMARK OFFICE

CERTIFICATE OF CORRECTION

PATENT NO. : 4,467,890

DATED : August 28, 1984

INVENTOR(S) : BRUCE D. McCALLUM, et al.

It is certified that error appears in the above—identified patent and that said Letters Patent is hereby corrected as shown below:

[73] Assignees: McCallum Enterprises Limited; Federated Farmers of New Zealand; Auckland Provine Inc., all of Auckland, New Zealand should be [73] Assignee: McCallum Enterprises Limited of Auckland, New Zealand Signed and Sealed this

*Fifth* Day of *March 1985*

[SEAL]

*Attest:*

DONALD J. QUIGG

*Attesting Officer* *Acting Commissioner of Patents and Trademarks*